United States Patent [19]

Prince

[11] Patent Number: 4,487,111

[45] Date of Patent: Dec. 11, 1984

[54] APPARATUS FOR GENERATING RECIPROCATORY MOTION

[75] Inventor: Brian E. Prince, Hailsham, England

[73] Assignee: Worcester Controls Corporation, West Boylston, Mass.

[21] Appl. No.: 294,130

[22] Filed: Aug. 19, 1981

[30] Foreign Application Priority Data

Sep. 4, 1980 [GB] United Kingdom ..... 8028627

[51] Int. Cl.[3] ..... F01B 31/00

[52] U.S. Cl. ..... 92/110; 92/130 C; 92/136; 92/138; 92/248

[58] Field of Search ..... 92/110, 112, 136, 138, 92/256, 181 R, 181 P, 182, 183, 163, 118, 248, 130 C; 91/234, 466, 467; 251/58

[56] References Cited

U.S. PATENT DOCUMENTS

| | | | |
|---|---|---|---|
| 2,251,241 | 7/1941 | Kellogg | 92/110 X |
| 2,590,155 | 3/1952 | Cannon | 91/234 X |
| 3,128,751 | 4/1964 | Dahl et al. | 92/138 X |
| 3,722,369 | 3/1973 | Maekawa et al. | 91/465 |
| 3,974,803 | 8/1976 | Lassota | 92/118 |
| 4,014,249 | 3/1977 | Taylor | 92/136 X |
| 4,212,324 | 7/1980 | Bauer | 137/625.66 |
| 4,233,887 | 11/1980 | Stoll | 92/169 |
| 4,281,588 | 8/1981 | Jashe | 92/136 X |

FOREIGN PATENT DOCUMENTS

| | | | |
|---|---|---|---|
| 2054798 | 2/1981 | United Kingdom | 92/136 |
| 425011 | 3/1974 | U.S.S.R. | 92/138 |

*Primary Examiner*—Abraham Hershkovitz
*Attorney, Agent, or Firm*—Pollock, Vande Sande & Priddy

[57] ABSTRACT

Apparatus for generating linear motion comprises a body on one end of which is mounted a cylinder. A piston in the cylinder is joined to an actuating beam extending into the body. The actuating beam has moving surfaces that cooperate with fixed surfaces in the body to define a linear bearing. Fluid under pressure is introduced through a duct in the body to a port in the fixed surface of the linear bearing. It enters the space in the cylinder above the piston via a port in a moving surface of the actuating beam which leads to a duct in the actuating beam that opens through the crown of the piston. A resilient sealing member between the fixed and moving surface of the linear bearing maintains fluid-tight communication between the fixed and movable part over their range of relative movement. The actuating beam may carry a rack that drives a pinion through ninety degrees as the piston travels, and two opposed cylinders may be provided to give a reciprocatory movement, or a spring return may be provided.

11 Claims, 9 Drawing Figures

APPARATUS FOR GENERATING RECIPROCATORY MOTION

FIELD OF THE INVENTION

This invention relates to apparatus for generating linear or more usually reciprocatory motion. It is of particular application to devices for actuating fluid control valves in which operation of the valve between its open and closed positions requires a 90° turn of a shaft in one direction or the other, but is of application in other situations where a limited stroke reciprocatory drive is required.

BACKGROUND TO THE INVENTION

Valve actuators are known of the kind in which an hydraulically or pneumatically activated piston is used to drive a shaft in either one direction or the other through an operative stroke of, say, 90°, via a rack and pinion mechanism. It is usual to employ a double-ended arrangement using two racks working on opposite sides of a common pinion so as to provide a balanced driving couple. Such devices are made in a variety of sizes and are expensive to produce because of the high grade components needed to deal with the hydraulic or pneumatic pressures and torques involved. It is an object of this invention to provide an actuator which can be produced at less cost by employing a system of construction using fewer parts and parts of a nature lending themselves to ease of manufacture by repetition techniques and a simplified system of assembly. By "repetition techniques" in this context are meant plastic moulding, die casting, pressing and the like processes.

Such actuators may be of the so-called double acting kind, in which hydraulic or pneumatic pistons are used to drive the mechanism in both directions or of the kind sometimes called "fail safe" in which the mechanism is driven in one direction hydraulically or pneumatically but is driven in the other direction by spring return means. This invention is applicable to both such kinds as will appear hereinafter.

SUMMARY OF THE INVENTION

According to the invention in one aspect apparatus for generating linear motion comprises a body, at least one cylinder mounted on and projecting from one side of said body, a piston in said cylinder, an actuating beam extending from said piston into said body, a bearing for guiding said piston and said actuating beam in linear motion having fixed surfaces defined by portions of said body in sliding contact with moving surfaces defined by portions of said actuating beam, and means for introducing fluid under pressure into said cylinder to actuate said piston, the improvement wherein said fluid introducing means comprises a fixed port defined by portions of a fixed surface of said linear bearing; a duct for fluid in said body leading to said fixed port; a movable port defined by portions of a movable surface of said linear bearing and communicating through a duct formed within said actuating beam and through the crown of said piston with a space in said cylinder above said piston; and a resilient sealing member between said fixed and moving surfaces of said linear bearing, which member defines the periphery of a connecting zone fluid-tightly communicating said fixed and movable ports over the range of relative movement thereof.

According to the invention in a further form there is provided a central body, a cylinder mounted on and projecting from one side of said body, a piston within said cylinder, an actuating beam extending from said piston into said central body and means for introducing pressure fluid into said cylinder to activate said piston, said means including a duct formed within said actuating beam and communicating at one of its ends through the piston head with the cylinder space above said piston and at its other end with fluid supply means within said central body, and spring return means mounted on said central body in a position opposed to said cylinder, said spring return means providing a return stroke for said actuating beam.

DESCRIPTION OF PREFERRED FEATURES

According to the invention in one form, the actuating beam carries a rack gear, said central body carries an output shaft, and a pinion on said output shaft engages with said rack gear to provide a reciprocatory rotational output from said shaft in response to reciprocating movements of said actuating beam. Said rack gear and said pinion are preferably housed within said central body. In a preferred arrangement said rack gear is mounted on a face of said actuating beam with the pitch line of said gear substantially coincident with the axis of said piston.

In a preferred form of mechanism according to the invention there is provided a central body, opposed cylinders located on either side of said central body, a piston within each of said cylinders and an actuating beam extending through said central body and connected between said pistons, and ducts extending in opposite directions within said actuating beam, each duct communicating through a respective piston head with the cylinder space above the respective piston, said ducts each communicating through a port with a fluid supply zone. Preferably the respective fluid supply zones are located on opposite sides of said actuating beam.

Where a spring return means is fitted it may comprise a multiple spring pack housed in a cylinder mountable on said central body in opposition to the cylinder containing said piston.

In a preferred arrangement according to the preceding paragraph said spring return means includes spring retraction means for holding said spring means retracted from its normal working position. Said retraction means may comprise cam means mounted on the outer end of the cylinder housing said spring pack and rotatable to withdraw the inner end of said spring pack and hold it in an inoperative position.

BRIEF DESCRIPTION OF THE DRAWINGS

In order that the invention may be better understood and carried into effect one construction thereof will now be described with reference to the accompanying drawings, in which.

Figure 1:
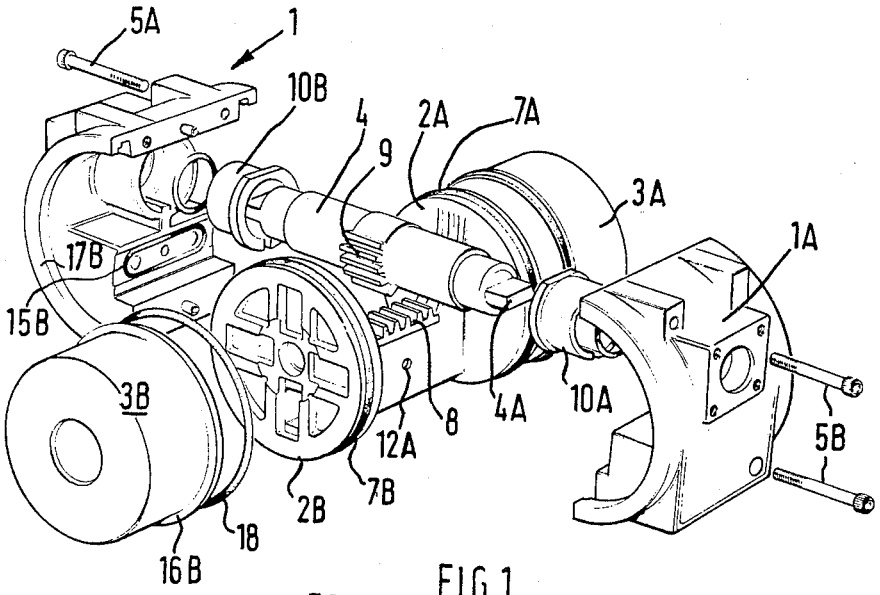
FIG. 1 is an exploded view of a double-acting valve actuator according to the invention.
Figure 2:
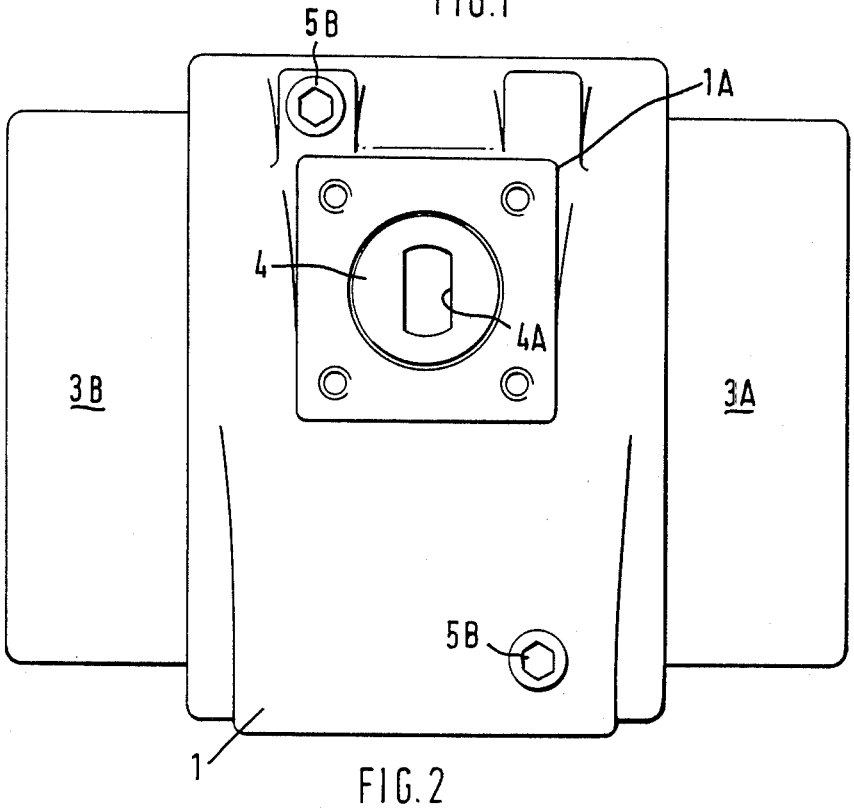
FIG. 2 is a side elevation of the valve actuator of FIG. 1.

The actuator as seen in FIGS. 1 and 2 comprises a central body 1 on which are mounted two opposed cylinders 3A and 3B. Passing through the central body and journalled in it is an actuating shaft 4. In the end of the shaft 4 there is a male or female drive member 4A of suitable size and shape to engage a corresponding drive member on the valve with which the actuator is to be used. It is an advantage of the invention that male or female ended drive pinions may be used as the customer application may require. The shaft 4 emerges through a squared boss 1A moulded integrally with the central body 1. The central body 1 is moulded in two symmetrical halves which are held together by clamping screws 5A and 5B and corresponding screws inserted from the other side and located in the diagonally opposite corners.

Figure 3:
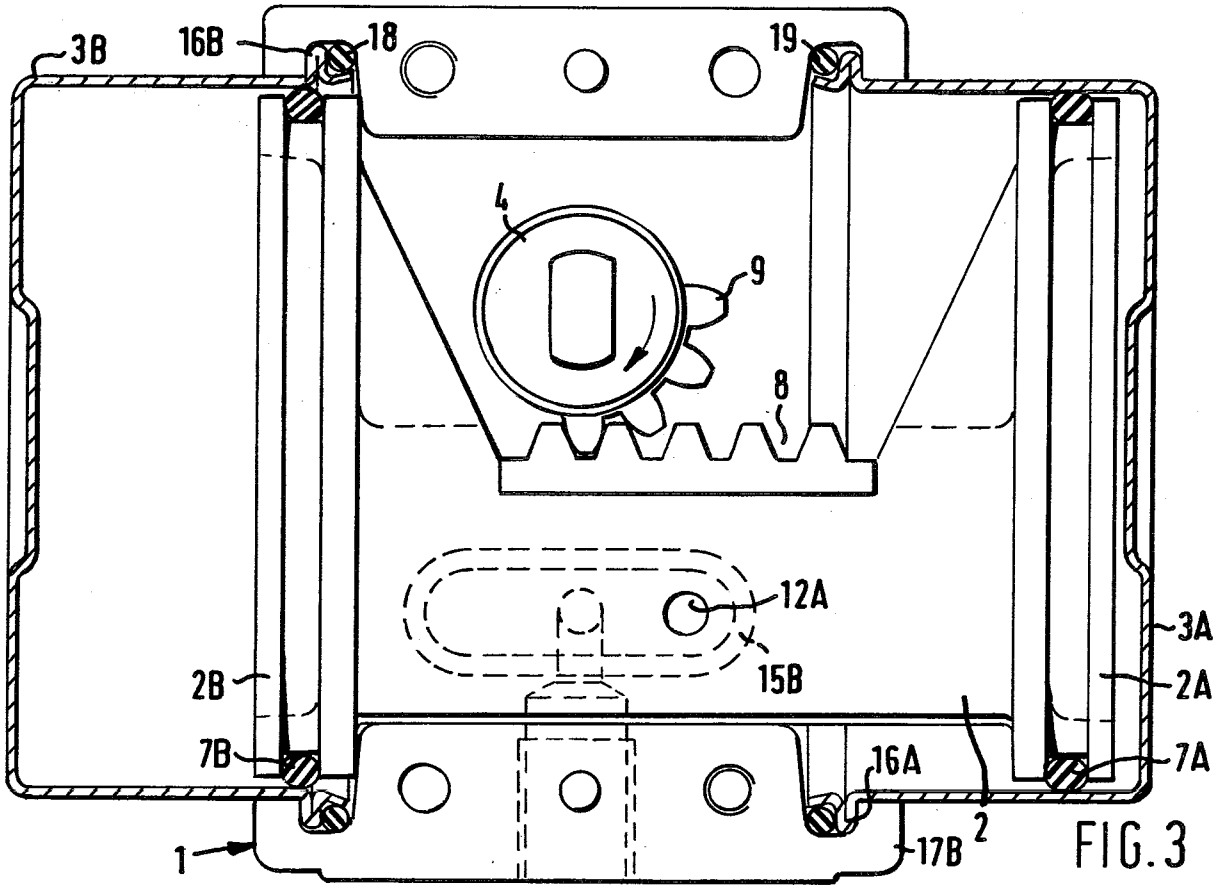
FIG. 3 is a view of the actuator of FIG. 1 but with one half of the central body removed and the cylinders in section.
Figure 4:
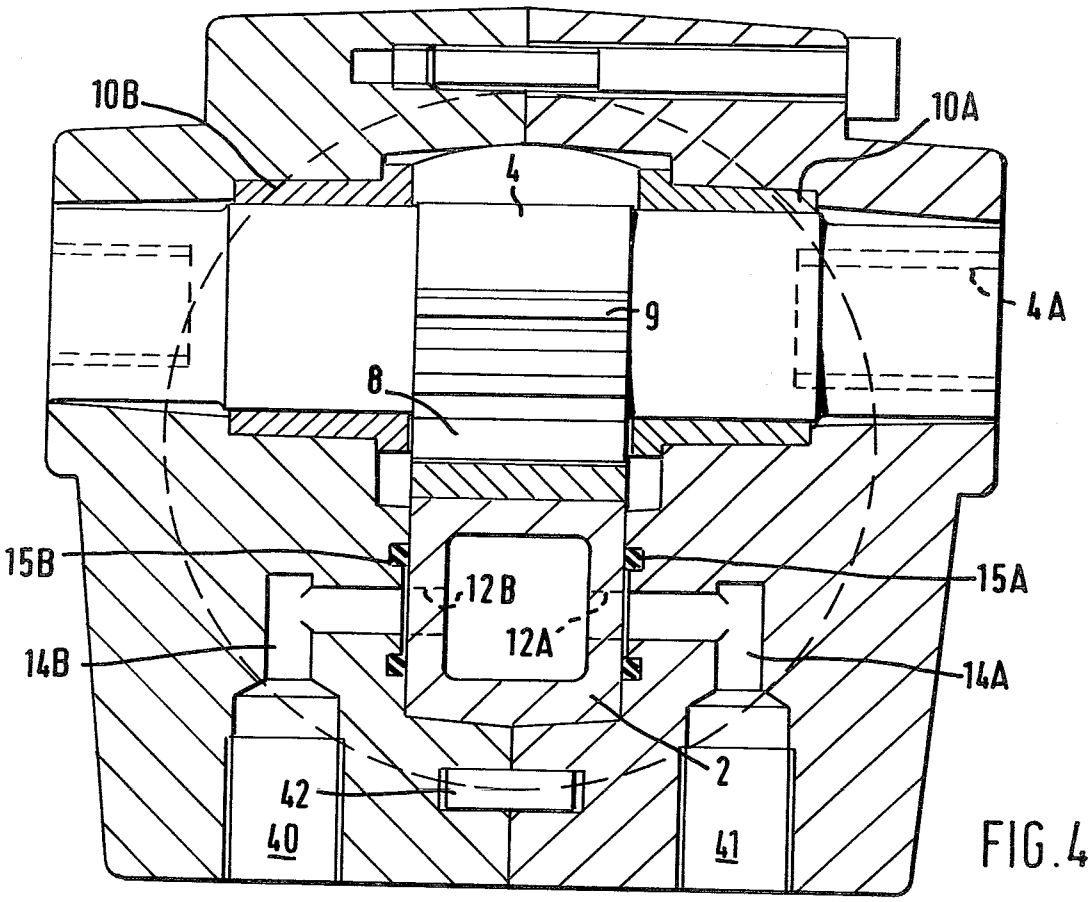
FIG. 4 is a cross-section on the center line of FIG. 3.

Looking now at FIGS. 3 and 4 it will be seen that within the central body 1 and the cylinders 3A and 3B there is located an actuator beam 2 which terminates at its ends in pistons 2A and 2B which are located in the respective cylinders 3A and 3B. The pistons are grooved and within the grooves are sealing rings 7A and 7B which form a sliding fluid-tight fit within their respective cylinders.

It will be noted that the actuating beam 2 which is of generally rectangular cross section is set eccentrically with respect to the cylinder bores in cylinders 3A and 3B. On its upper face as viewed in FIGS. 1 and 3 the beam 2 carries a rack gear 8 and the eccentricity of beam 2 enables the pitch line of this rack gear to coincide with the axis through the pressure centers of the pistons, ie. the central axis through the pistons. There is thus no turning moment in the pistons and no tendency therefore for the pistons to jam in their cylinders when under load.

The rack gear 8 engages a sequential gear 9 on the output drive shaft 4. Thus movement of the actuator beam 2 from its extreme position on the right, as seen in FIG. 3 to its extreme position on the left will turn the output shaft through one quarter turn. Such a movement is required to turn a valve from its "on" position to its "off" position or vice versa.

It will be seen from FIG. 4 that the shaft 4 is journalled on either side of the pinion 9 at 10A and 10B in each of the two halves of which the central body 1 is constructed.

It will also be seen from FIG. 4 that the actuator beam 2 is supported in a linear bearing whose stationary surface is defined by a channel formed between the two component halves of the central body 1. Its lower surface contacts the floor of the channel which is made of a shallow "V" profile, the surface of the actuator beam being of corresponding cuneiform profile. This configuration facilitates the manufacture of the mechanism by die-casting techniques to a high standard of accuracy. Furthermore, in use the component of thrust on the rack gear 8 normal to the axis of the pistons 7A, 7B opposes lateral thrust on the actuating beam 2 at fluid supply zones (described below) to maintain the actuating beam in correct alignment.

Within the beam 2 two bores 11A and 11B (FIG. 5) are provided extending from an intervening wall in the center of the beam in opposite directions to the respective piston crowns. These bores are tapered off towards the center of the beam in an overlapping manner so as each to communicate with a port 12A and 12B (FIG. 4) on a side wall of the beam on the opposite sides thereof which face the side walls of the channel which houses beam 2. The arrangement will be better understood from FIG. 5 which is a cross-sectional view of the center portion of beam 2.

At their other ends the bores 11A and 11B communicate through ports in the crowns of the respective pistons with the cylinder spaces above the pistons.

Figure 5:
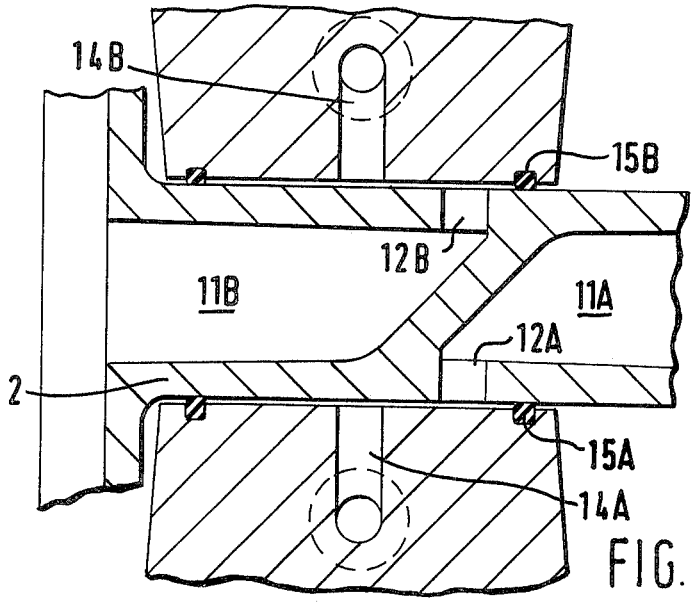
FIG. 5 is a sectional view of a portion of the device illustrated in FIGS. 1 to 4.

The ports 12A and 12B communicate with fluid supply ducts 14A and 14B provided in the respective halves of the central body 1 by way of connecting zones formed between the side faces of the actuator beam and the opposed walls of the channel in which the beam operates. These zones are defined by sealing rings seated into the walls of the channel as shown in FIGS. 4 and 5 at 15A and 15B and in dotted outline in FIG. 3. The sealing rings, which are shown as of circular section plastics materials but may be of any suitable material and cross section are seated in grooves formed in the channel walls in an elongated oval configuration and surround an area equivalent to or slightly greater than that swept by the ports 12A and 12B in moving over their operative strokes. They form a seal between the respective channel wall and the corresponding side face of the actuator beam, the face of the actuator beam making sliding contact therewith. A shallow chamber is thus formed between the face of the actuator beam and the inner wall of the channel from which the face of the actuator beam has a small clearance.

Figure 6:
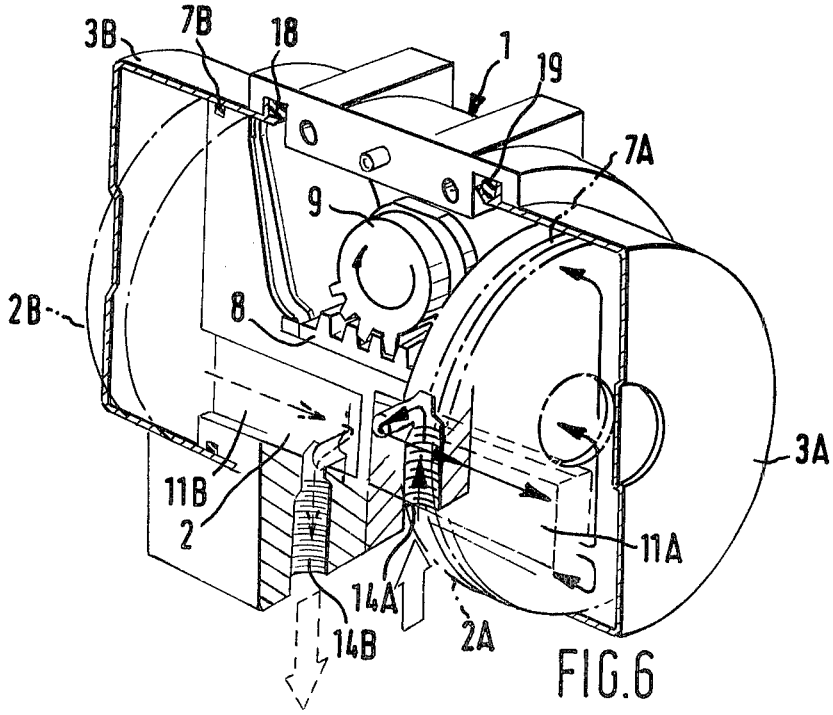
FIG. 6 is a diagram of the operational sequence of the actuator with one half of the central body removed and the piston and actuating beam in section.

It will now be seen that the introduction of hydraulic or pneumatic pressure fluid through say duct 14A (solid arrows in FIG. 6) will supply the connecting zone within sealing ring 15A and thus through port 12A and bore 11A to the space above piston head 2A in cylinder 3A, thus forcing the piston and actuator beam 2 to the left (as seen in FIG. 6) thus turning the pinion 9 clockwise through one quarter turn. Air from cylinder 2B vents through passage 11B and through duct 14B (dotted arrows in FIG. 6). The drive in the reverse direction is obviously achieved by introducing pressure fluid through duct 14B and venting air through duct 14A.

It will further be seen that the only access to the spaces above the piston heads in cylinders 3A and 3B for pressure fluid is through the ports and bores in the piston heads and actuator beam. Thus the cylinders themselves can be made without connecting ports or valves and lend themselves to manufacture by simple methods. As shown in the construction illustrated the cylinders are made as drawn sheet metal cups. They are held in place by lips retained in grooves formed in the central body. Thus, is shown in FIG. 3, the lip 16A formed on cylinder 3A and the lip 16B formed on cylinder 3B are each held within a groove formed by an inturned flange, e.g. 17B, formed on the central body. An "O" ring 18 provides a resilient support between the central body and the lip 16B. However, it will be noticed that this support is not required to withstand the pressure of actuating fluid. The cylinder 3A is similarly mounted, using an "O" ring 19 associated with lip 16A. This arrangement has the advantage that the interior of the body containing the rack and pinion is not pressurized with working fluid and so there are no problems of fluid leakage as the rack and pinion wear in service and no reason for the pinion to become ejected. Furthermore, the arrangement is inherently safe against dismantling the halves of the body by withdrawing the bolts connecting them because if this is attempted the pressure at the connecting zone and within the cylinder will be relieved before the cylinders are released from their captive position within the body.

The arrangement so far described is a so-called double acting valve actuator since actuation is carried out by hydraulic or pneumatic pressure in both directions. A spring return system can, however, be substituted for one of the hydraulic cylinders as will now be described with references to FIGS. 7, 8 and 9.

The spring pack is housed in a cylinder 20 provided at its open end with a folded lip 21, corresponding to the lips 16A and 16B on the cylinders 3A and 3B, and by which it may be mounted in the assembly in the same manner as has been described above. However, the cylinder 20 is deeper than cylinders 3A and 3B so as to accommodate compression springs of a suitable length. A group, in this case of six such springs 22 is provided grouped around a central stem to be described later. At one end the springs bear upon the closed end of the cylinder 20. At their other end they bear upon a pressure plate 23 which, in operation will bear upon the end face of a piston head (2A or 2B according to which end of the assembly the spring pack is fitted) at one end of actuator beam 2. The ends of the springs are located on bosses 24, 25 etc., spaced around the pressure plate. Their ends may also be guided between the pins of a spider which may be made of plastics material, the central core of which is fitted over a central boss 28 set up on the pressure plate 23. The number of springs is not material but should be such as to provide a balanced force on pressure plate 23.

Set in the closed end of cylinder 20 and located against turnout eg., by a key and keyway is a bush 30 through which passes a central tubular stem 31. Outwardly of bush 30 is a cam 32, the cam face 32A of which bears on a cam face 30A formed on the outer face of bush 30. Cam 32, the purpose of which will be described later, is held beneath the head 31A of the central stem 31 and is located on the stem by means of a keyway (not shown) engaging on a key formed on the central stem so that when the cam 32 turns, the stem turns with it. A conical spring 34, which is located at its inner end in a groove 35 formed on the central stem by means of a washer and circlip, and at its outer end on the end face of cylinder 20, maintains the cam faces 30A and 32A in contact.

The inner end of stem 31 is internally screw threaded at 36 and a screw 37 is inserted through the inner face of the boss 28 to retain the pressure plate 23 within the assembly. A clearance hole 38 allows freedom for the pressure plate 23 to move inwardly with the inner end face of boss 28 riding over a reduced diameter end portion on stem 31. Thus when the spring pack is in use the pressure plate 23 can be moved against the pressure of springs 24, 25 etc., to permit actuation of the valve actuator and can be returned by the pressure of the springs when the hydraulic actuating pressure is released or fails.

The purpose of the cams 30, 32 is to facilitate assembly of the spring pack in an actuator assembly of the kind described above.

The assembly of a "double acting" actuator is carried out as follows. First the piston rings 7A and 7B are mounted on the piston heads 2A and 2B. The sealing rings 18 and 19 are mounted on the end flanges of cylinders 3A and 3B and the cylinders are engaged over the piston heads. The assembly thus formed is then set into one half of the central body 1 with the sealing rings 18 and 19 engaged in the grooves provided for them. The sealing ring 15B will have been previously located in its groove. The shaft 4 is then introduced through bearing 10A, the teeth of segmental gear 9 being in engagement with the teeth of rack gear 8 in the appropriate location according to the position of actuator beam 2. For this to be done correctly the beam is preferably placed at one end of its travel, ie. with one piston head at the top of its stroke, so that the gear 9 may be placed at its corresponding starting point. The other half of the central body, with its sealing ring 15A already in position is then engaged over the assembly so far brought together, the bearing 10B engaging over the shaft 4 and the cylinder flanges 16A and 16B being received into the grooves of the central body part. Bolts 5A and 5B can then be inserted and the structure bolted together by bolts from both sides as above described.

Figure 7:
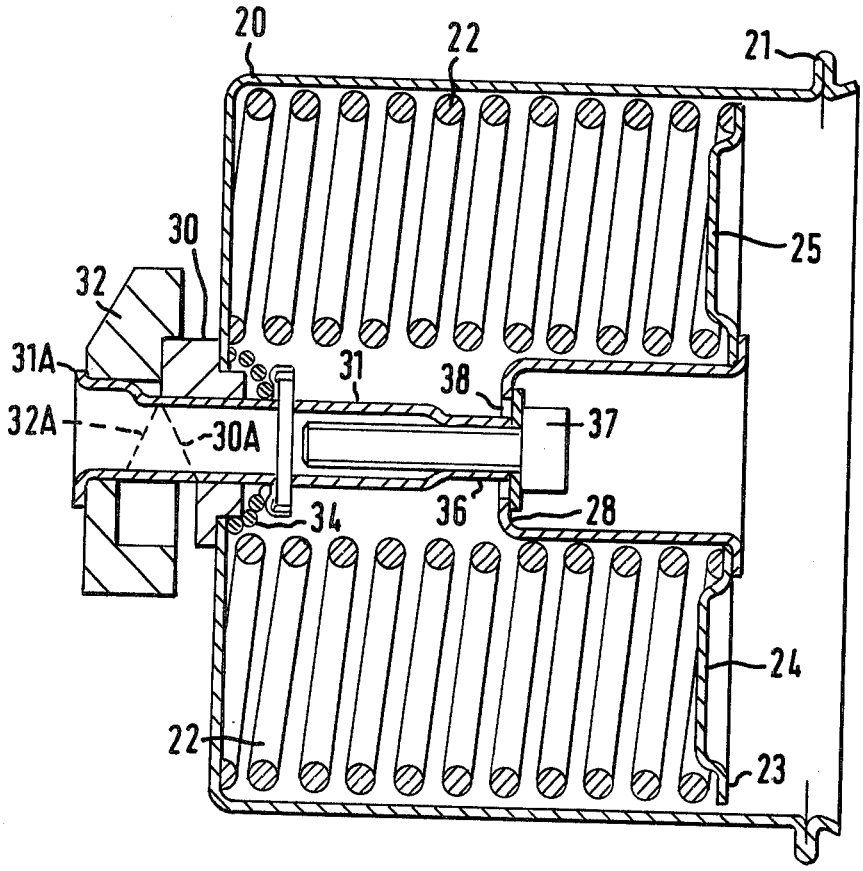
FIG. 7 is a sectional view of a spring return assembly for an actuator of the kind shown in FIGS. 1 to 6.
Figure 8:
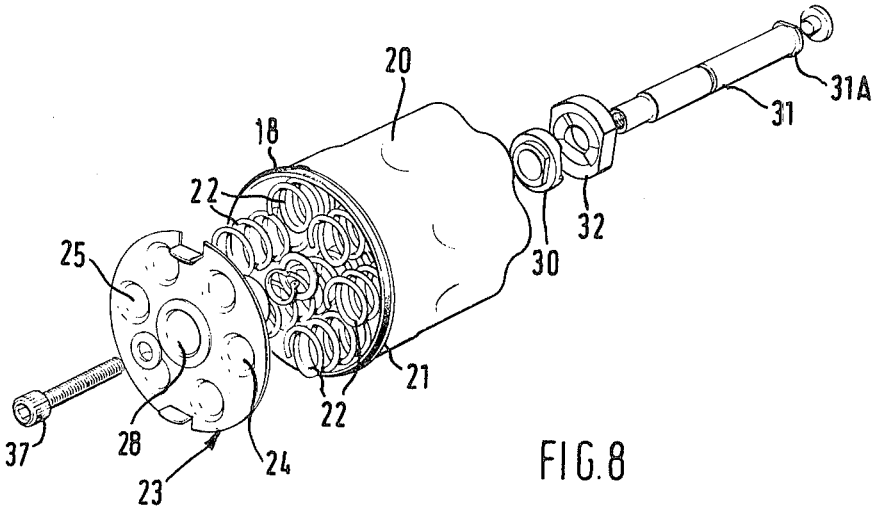
FIG. 8 is an exploded view of the spring return assembly of FIG. 7.

For this operation to be carried out without difficulty when a spring pack as above described is substituted for one of the cylinders 3A, 3B the cams 30 and 32 are brought into use. By turning the stem head 31A by the appropriate amount, say half a turn, the cams are brought to their high level so that the stem 31 is drawn up (to the left as seen in FIG. 7) and the springs are compressed so that the piston head at that end of the device can enter the cylinder 20 by an appropriate amount and without load. When the assembly has been completed the cam 32 can then be returned to its original position, thus releasing the spring assembly into its normal working position. The cam 32 is likewise used to withdraw the springs when the device is disassembled.

Figure 9:
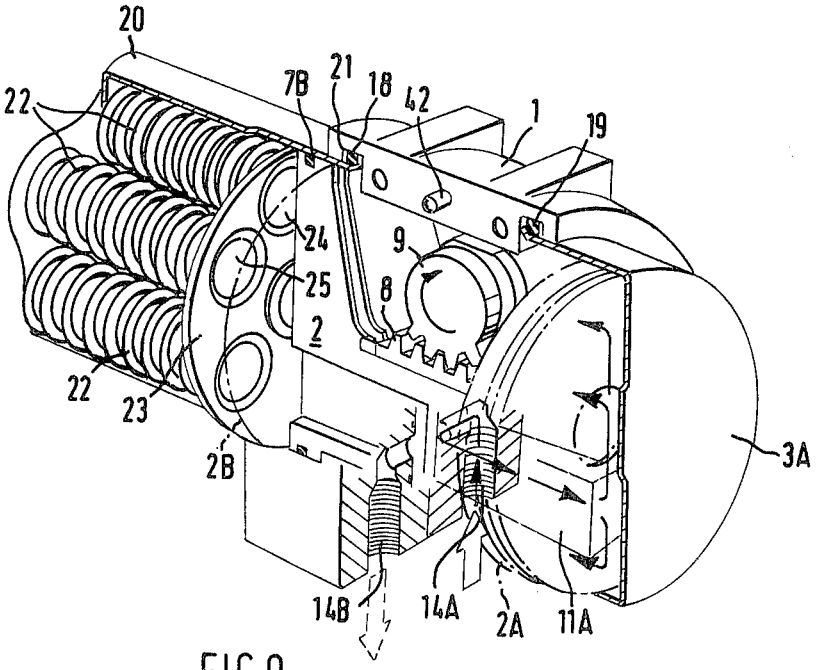
FIG. 9 is an operational sequence diagram similar to FIG. 6 but with a spring return assembly fitted.

The operational diagram is shown in FIG. 9 and it will be noted that supply of working fluid through port 12A causes the beam 2 to be moved through its working stroke. Release of the air pressure allows springs 22 acting through thrust plate 23 to return beam 2 to its rest position.

Hydraulic or pneumatic connections can be made to the device by means of nipples provided at 40 and 41 (FIG. 4) which, it will be noted are included one on each body half. Dowels may be provided, suitably placed to locate the body halves together one such being shown at 42 (FIG. 4).

It will be appreciated that the construction described and illustrated is in virtually all respects symmetrical so that production by die-casting and moulding techniques involves a minimum of tooling. Thus the two halves of the central body are entirely alike so that only one die is required. Similarly the actuator beam/piston item is a single moulding which may be made in suitable plastics material. The rack gear 8 is preferably metallic and attached to the actuator beam in any suitable manner, or it may be moulded integrally therewith. Again, the same central body and actuator beam/piston parts may be used even though a spring return assembly is to be employed. Furthermore, since the arrangement provides access to both ends of the actuating shaft 4 different drive sockets or male connections may be provided at either end to adapt the device to a variety of valves which it is required to operate.

I claim:

1. A fluid operated actuator including a body, first and second cylinders mounted coaxially on and projecting from opposed sides of said body, a piston unit that is a one piece molding of rigid plastics material defining first and second pistons in said cylinders and a beam extending through said body between said pistons, portions of said body defining a linear bearing that slidably locates said beam to guide said piston unit for reciprocation within a restricted linear travel without permitting said piston to rotate relative to said body, said linear bearing including means defining a planar surface on said beam and means defining a planar surface in said body with said planar surfaces being in confronting relationship to one another, and means for introducing fluid under pressure into at least one of said first and second cylinders to move said piston unit from one end of its travel to the other, said fluid introducing means comprising:

a fixed port defined by portions of said planar bearing surface of said body;

a duct in said body for leading fluid to said fixed port;

a movable port defined by portions of said planar surface of said beam communicating with said at least one cylinder through a duct formed within the beam that opens through the crown of one of the pistons; and a resilient sealing member of generally oval outline that is retained in a recess in said planar bearing surface of said body to make wiping contact with said planar bearing surface of said beam and to encircle said fixed port and said movable port over the range of travel of said piston unit so that said sealing member maintains said fixed and movable ports in fluid-tight communication.

2. An actuator according to claim 1 wherein said beam carries a rack gear, said body carrying an output shaft, and a pinion on said output shaft which meshes with said rack gear to provide a rotational output to said shaft in response to linear movement of said beam, said rack gear and pinion being housed within said body, and said rack gear being mounted on said beam with the pitch line of said rack gear substantially coincident with the axis of said piston.

3. An actuator according to claim 2 wherein said beam is generally rectangular in cross section and has an upper face to which the rack gear is fixed, said beam also having first and second side faces and a lower face each constituting a moving surface of said linear bearing, said movable port being formed in one of said side faces.

4. An actuator according to claim 3 wherein the lower face of said beam is cuneiform and slides over a corresponding grooved face forming part of said fixed surface of said linear bearing whereby the separation force at the rack gear normal to the axis of the piston produces a reaction on the lower face of the beam that opposes the lateral thrust on said beam at said fluid supply zone to maintain said beam in correct alignment.

5. An actuator according to claim 1 wherein said cylinders are metal cups having a formation on their rim which mates with a formation in said body, a resilient annular support between said cylinders and said body, and a sealing member secured to the periphery of said pistons to maintain a fluid-tight seal between said pistons and said cylinders so that said annular support is not exposed to fluid pressure, said sealing member being operative to urge said cylinders into alignment with said pistons within a range of mechanical movement permitted by the annular seal.

6. An actuator according to claim 1 wherein said linear bearing includes means defining two planar bearing surfaces on opposed sides of said beam confronting respective planar bearing surfaces in said body, first and second fixed ports defined by portions of said planar bearing surfaces of said body, first and second ducts in said body for leading fluid to respective fixed ports, first and second movable ports defined by portions of said planar bearing surfaces of said beam and communicating with said first and second cylinders through respective ducts formed within the beam and opening through the crown of respective pistons, and resilient sealing members of generally oval outline retained in said opposed bearing surfaces of said body and making wiping contact with said bearing surfaces of said beam, each of said resilient sealing members encircling a respective one of said first and second fixed ports and said first and second movable ports over the range of travel of said piston unit so that each of said sealing members maintains respective fixed and movable ports in fluid-tight communication.

7. An actuator according to claim 6 wherein said ducts in said beam are divided from one another by an intervening wall within the beam.

8. An actuator according to claim 1 wherein the other of said cylinders has within it spring return means acting against the other of said pistons to provide a return stroke for said piston unit.

9. An actuator according to claim 8 wherein said spring return means comprises a multiple spring pack and a thrust plate which locates in force-transmitting relationship with the other of said pistons.

10. Apparatus according to claim 9 wherein said spring return means includes spring retraction means for holding said spring return means retracted from its normal working position.

11. Apparatus according to claim 10 wherein said retraction means comprises cam means mounted on the outer end of a cylinder housing said spring pack and rotatable to withdraw the inner end of said spring pack and hold it in a position clear of a piston withdrawal datum position.

* * * * *